United States Patent [19]

Clampitt et al.

[11] 4,088,919

[45] May 9, 1978

[54] ION SOURCE INCLUDING A POINTED SOLID ELECTRODE AND RESERVOIR OF LIQUID MATERIAL

[75] Inventors: Roy Clampitt, Abingdon; Derek Kirk Jefferies, Didcot, both of England

[73] Assignee: United Kingdom Atomic Energy Authority, London, England

[21] Appl. No.: 786,872

[22] Filed: Apr. 12, 1977

[30] Foreign Application Priority Data

Apr. 13, 1976 United Kingdom ..... 15111/76

[51] Int. Cl.[2] ..... H01J 1/02; H01J 1/30; H05H 1/00

[52] U.S. Cl. ..... 313/362; 313/232; 313/309; 313/336; 313/351

[58] Field of Search ..... 313/336, 351, 309, 232, 313/174, 163, 362

[56] References Cited

U.S. PATENT DOCUMENTS 3,122,882 3/1964 Schultz et al. ..... 313/362 X 3,475,636 10/1969 Eckhardt ..... 313/163 X 3,911,311 10/1975 Heil ..... 313/362 X

OTHER PUBLICATIONS

"Electrohydrodynamic Ion Source," by J. F. Mahoney et al., Journal of Applied Physics, vol. 40, No. 13, Dec. 1969, pp. 5101–5106.

*Primary Examiner*—Palmer C. Demeo

*Attorney, Agent, or Firm*—Larson, Taylor and Hinds

[57] ABSTRACT

An ion source comprising an electrode consisting of at least one body made of a material such as to be perfectly wetted by a liquid material ions of which are to be emitted by the source and not corrodible by that material, and having a termination the radius of curvature of which is such that a jet of the liquid material will form and be anchored to the termination of the electrode under the influence of an electric field, means for applying the ionizing electric field and a reservoir for the material ions of which are to be emitted by the source.

13 Claims, 3 Drawing Figures

ION SOURCE INCLUDING A POINTED SOLID ELECTRODE AND RESERVOIR OF LIQUID MATERIAL

Figure 1:
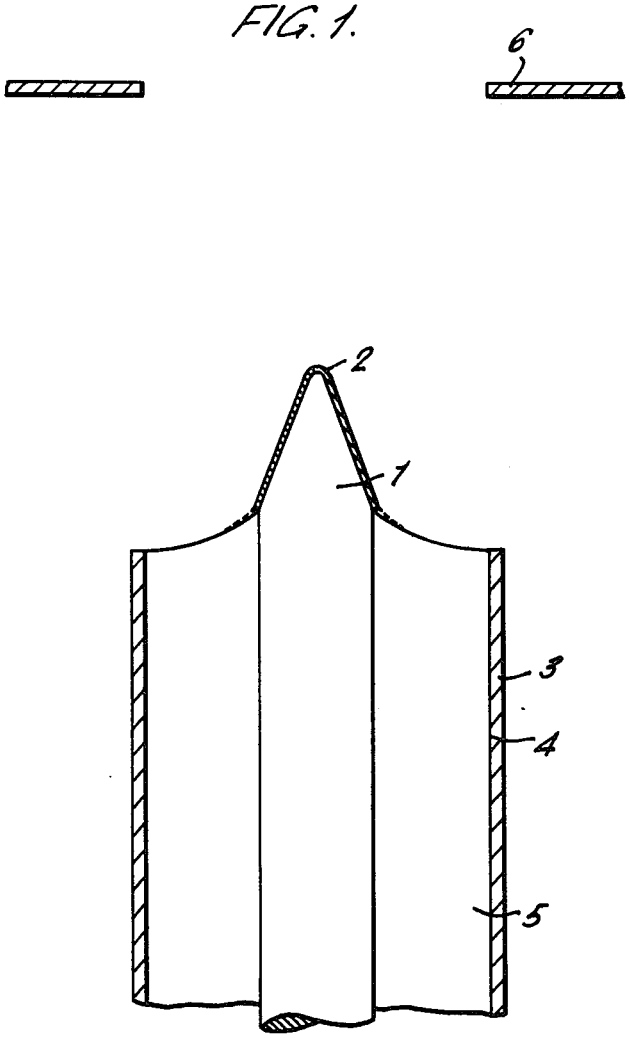

The present invention relates to ion sources and more specifically to single-point sources of metal ions.

According to the present invention there is provided an ion source comprising an electrode consisting of at least one body made of a material such as to be perfectly wetted by a liquid material ions of which are to be emitted by the source and not corrodible by that material, and having a termination the radius of curvature of which is such that a jet of the liquid material will form and be anchored to the termination of the electrode under the influence of an electric field, means for applying the ionizing electric field and a reservoir for the material ions of which are to be emitted by the source.

The electrode may be a single pointed body, an array of pointed bodies, or a sheet of material one edge of which is sharpened to provide the termination on which the jet is formed. If the electrode is a sheet of material, then the term "jet" is intended to apply to the layer of liquid material ions of which are to be emitted by the source, which forms along the edge of the sheet, and not to the individual cusps which form at the outer edge of the layer under the action of the ionizing field.

According to the present invention, in a particular aspect, there is provided a single point ion source comprising, an electrode made of a material such as to be perfectly wetted by a liquid material ions of which are to be emitted by the source and not corrodible by that material and having an apex with a radius of curvature such that only a single jet of liquid material ions of which are to be emitted by the source will form and be anchored to the apex of the electrode under the influence of an ionizing electric field means for applying the ionising electric field, and a reservoir for the liquid material to be ionized.

Preferably the liquid material is a molten metal and the reservoir comprises a sheath surrounding the electrode. There also may be provided means for supplying heat to the metal to maintain it in the molten state.

Various materials can be used to form the electrode, for example it can be made of metal, glass or a ceramic material. The criteria are that the electrode must not be corroded by the material to be emitted by the source, and that the electrode must be perfectly wetted by the liquid material to ensure that the film of liquid material which is formed on the surface of the electrode is of uniform thickness at all times. Also, when the reservoir is a sheath surrounding the electrode, the termination of the electrode should protrude from the sheath by an amount such that the meniscus formed by the liquid material does not interfere with the supply of liquid material to the termination of the electrode. On the other hand, the electrode should not project by an amount such as to cause irregularities in the supply of liquid material to the termination of the electrode. In practice, it is found that the amount of protrusion should be in the range 0.1 to 0.2 cm.

The radius of curvature of the termination of the electrode must lie in a range the lower limit of which is controlled by the need to field-form and anchor at the termination of the electrode a jet of liquid material which is an essential precursor to stable and intense ion emission, and the upper limit of which is controlled by the need to ensure that only one jet is formed on the termination of the electrode. In practice this range is found to extend from 1 - 10 μm.

The thickness of the electrode is not critical. If the electrode is made of one or more pointed bodies, then for mechanical stability, ease of manufacture and handling, a diameter greater than approximately 100 μm is satisfactory.

Figure 2:
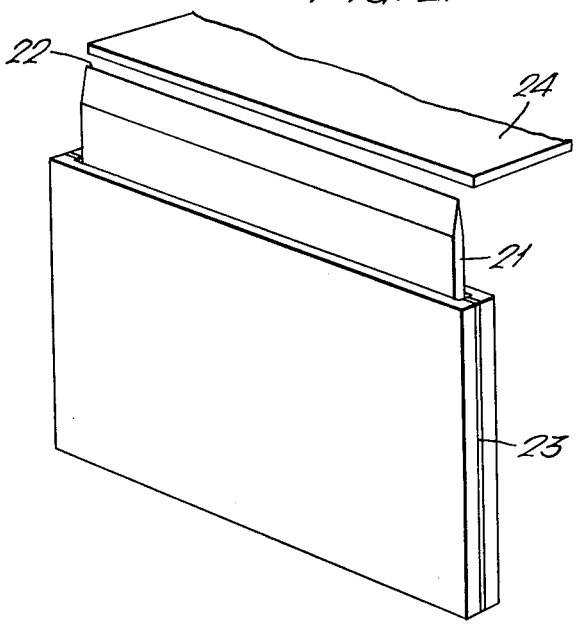
Figure 3:
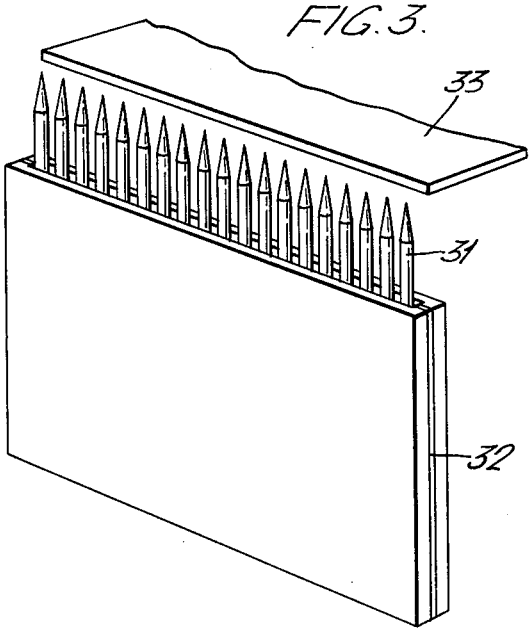

The invention will now be described, by way of example, with reference to the accompanying drawings in which:

FIG. 1 is a cross-section of a single point ion source embodying the invention, FIG. 2 is a representation of another embodiment of the invention, and FIG. 3 is a representation of a third embodiment of the invention.

Referring to FIG. 1 of the drawings, a single point source for producing lithium ions consists of a central tungsten wire electrode 1 which has a diameter of about 100 μm. The electrode 1 is pointed and has an apex 2 with a radius of curvature of about 5 μm. The electrode 1 is surrounded by a tube 3, also made of tungsten, from which the electrode 1 projects by about 0.1 cm. The diameter of the tube 3 is 150 μm and the space between the electrode 1 and the inner wall 4 of the tube 3 acts as a reservoir for molten lithium metal 5, ions of which are to be emitted by the source. In order to ensure that the electrodes are completely wetted by the lithium 5, prior to filling the tube 3 with lithium, the assembled source is cleaned by heating it in an atmosphere of flowing hydrogen. In use, the temperature of the ion source is maintained at a temperature just above the melting-point of the lithium.

The electric field required to ionize the lithium is generated between the electrode 1 and a nearby apertured electrode 6. Usually, the ionizing voltage is applied to the electrode 1.

Referring to FIG. 2, another alkali metal ion source embodying the invention comprises an electrode 21 in the form of a sheet of tungsten approximately 100 μm in thickness and some 5 cm in length. An edge 22 of the electrode 21 is sharpened to a transverse radius of curvature of about 5 μm.

Such a radius of curvature causes a layer of liquid alkali metal to form at the edge 22 of the electrode 21. Under the action of an ionizing electric field the edge of this layer forms into a number of cusps. The electrode 21 is surrounded by a sheath 23, which also is made of tungsten, and from which it projects by approximately 0.1 cm. The sheath 23 is separated from the electrode 21 by a gap of approximately 25 μm, thus providing a reservoir for the alkali metal ions of which are to be emitted by the source.

The electric field required to ionize the alkali metal is generated between the electrode 21 and a nearly apertured electrode 24 in a manner similar to that already described for the first embodiment.

Also as before, in use, the source is operated at a temperature just above the melting point of the alkali metal concerned.

Referring to FIG. 3, there is shown another embodiment of the invention in which the electrode consists of an array 31 of separate tungsten wires each of which is similar to that described in connection with the first embodiment of the invention. The array 31 of tungsten wires is surrounded by a tungsten sheath 32. As before, the wires forming the electrode 31 project from the sheath 32 by approximately 0.1 cm and there is a gap of approximately 25 μm between the sheath 32 and the electrode 31 so as to provide a reservoir for the alkali metal ions of which are to be emitted by the source.

Again, a nearby apertured electrode 33 is provided to enable the necessary ionizing electric field to be generated, and the source is operated at a temperature just above the melting point of the alkali metal ions of which are to be emitted by the source.

In all the embodiments described, it may be necessary to provide additional heating to ensure that the metal ions of which are to be emitted by the source is in a liquid state. Conveniently this can be done electrically.

The ion beams produced by the sources described can be collimated, refocused or otherwise directed by the incorporation of appropriately placed and shaped electrodes.

Although the sources have been described in relation to the emission of lithium ions in particular, and alkali metal ions in general, such sources can be used for other materials provided that the two criteria of wettability and non-corrosion are fulfilled. For example, a vitreous carbon-surfaced electrode can be used to produce ions of aluminium or silicon, or an electrode having an aluminium oxide surface can be used to produce nickel ions.

We claim:

1. An ion source comprising a solid electrode made of a material such as to be perfectly wetted by a liquid material ions of which are to be emitted by the source and not corrodible by that material, and having a termination the radius of curvature of which is such that a jet of liquid material will form and be anchored to the termination of the electrode under the influence of an electric field, means for controlling the rate of transport of the liquid material over the surface of the electrode so that ions of the material are produced at the tip of the jet of liquid material under the action of the electric field, means for generating the ionizing electric field and a reservoir for the material ions of which are to be emitted by the source.

2. An ion source according to claim 1 wherein there is provided means for maintaining in the liquid state the material ions of which are to be emitted by the source.

3. An ion source according to claim 1 wherein the electrode is made of a refractory metal.

4. An ion source according to claim 1 wherein at least that part of the surface of the electrode which is in contact with the liquid material ions of which are to be emitted by the source is made of a vitreous material.

5. An ion source according to claim 1 wherein at least that part of the surface of the electrode which is in contact with the material to be ionized is made of ceramic material.

6. An ion source according to claim 1 in conjunction with at least one other electrode.

7. An ion source according to claim 1 wherein the radius of curvature of the termination of the electrode is between 1 and 10 μm.

8. An ion source according to claim 7 wherein the electrode is a single pointed body.

9. An ion source according to claim 7 wherein the electrode is a sheet of material an edge of which is sharpened to provide the said termination.

10. An ion source according to claim 7 wherein the electrode comprises an array of pointed bodies.

11. An ion source according to claim 1 wherein the means for controlling the rate of transport of the liquid over the surface of the electrode comprises a sheath surrounding the electrode but spaced apart from it, the termination of the electrode projecting from the sheath, by an amount such that, in combination with the gap between the sheath and the electrode, the meniscus formed at the surface of the liquid maintains the required rate of transport of the fluid over the surface of the electrode.

12. An ion source according to claim 11 wherein the electrode protrudes from the sheath by a distance of 0.1 to 0.2 cm.

13. A single point ion source comprising a solid pointed electrode made of a material such as to be perfectly wetted by a liquid material ions of which are to be emitted by the source and not corrodible by that material and having an apex with a radius of curvature such that only a single jet of liquid material ions of which are to be emitted by the source will form and be anchored to the apex of the electrode under the influence of an ionizing electric field, means for controlling the rate of transport of the liquid material over the surface of the electrode so that ions of the material are produced at the tip of the jet of liquid material, means for applying the ionizing electric field and a reservoir for the liquid material to be ionized.

* * * * *